US005429852A

United States Patent [19]

Quinn

[11] Patent Number: 5,429,852

[45] Date of Patent: Jul. 4, 1995

[54] TRANSPORTABLE CHAIR PAD

[76] Inventor: Raymond Quinn, 31 Hillside Ave., New Hartford, N.Y. 13413

[21] Appl. No.: 250,824

[22] Filed: Jul. 11, 1994

Related U.S. Application Data

[63] Continuation-in-part of Ser. No. 994,285, Dec. 21, 1992, abandoned.

[51] Int. Cl.[6] ..... A47C 7/18; A47C 27/05; A47C 27/15

[52] U.S. Cl. ..... 428/71; 5/470; 5/471; 5/472; 5/481; 5/653; 5/654; 5/925; 297/452.26; 297/452.41; 297/452.46; 297/452.48; 297/452.61; 297/DIG. 1; 428/76; 428/137; 428/138; 428/187; 428/192; 428/319.3; 428/319.7; 428/409; 428/423.1; 428/424.2; 428/424.4; 428/424.6

[58] Field of Search ..... 428/68, 71, 76, 69, 428/137, 138, 131, 192, 194, 178, 140, 187, 319.7, 319.3, 409, 423.1, 424.2, 424.6, 424.4; 5/653, 654, 481, 472, 470, 471, 925; 297/DIG. 1, 452.26, 452.48, 452.61, 452.41, 452.46

[56] References Cited

U.S. PATENT DOCUMENTS

| | | | |
|---|---|---|---|
| 3,111,689 | 11/1963 | Mulhauser | 297/DIG. 1 |
| 3,298,047 | 1/1967 | Fewerman | 5/472 |
| 4,292,703 | 10/1981 | Goguen | 5/472 |
| 4,457,032 | 7/1984 | Clarke | 5/925 |
| 4,627,660 | 12/1986 | Kon | 297/219 |
| 5,015,037 | 5/1991 | Giblin | 297/452 |

OTHER PUBLICATIONS

A Glossary of Industry Urethane Terms, by S. Alan Stewart, The Martin Sweets Company, Inc., 1971.

*Primary Examiner*—Nasser Ahmad
*Attorney, Agent, or Firm*—George R. McGuire

[57] ABSTRACT

A transportable chair pad and method of making the same comprises a top vinyl layer; a relatively thick polyurethane core layer; a bottom, non-clickable ester urethane foam layer; and a reinforcing vinyl layer fixedly attached to the inwardly facing surface of the bottom foam layer. The polyurethane layer is provided with a plurality of holes extending entirely therethrough. The chair pad is assembled with a sandwich type, vacuum and heat sealing machine with the heat seal seams being formed about the periphery of the polyurethane layer as well as within each hole formed through the polyurethane foam layer. The bottom vinyl layer further includes a plurality of holes to provide aeration.

2 Claims, 3 Drawing Sheets

TRANSPORTABLE CHAIR PAD

REFERENCE TO RELATED APPLICATION

This application is a continuation-in-part of my previous application Ser. No. 07/994,285, filed Dec. 21, 1992, now abandoned.

BACKGROUND OF THE INVENTION

The present invention relates to pads of the type which are removably positioned upon the seat of a chair and, more particularly, to a non-skid, cushioned chair pad formed from a plurality of distinct layers surrounding a polyurethane foam center. The present invention further relates to a novel and improved method of forming the chair pad.

Conventional chair pads, as commonly used by spectators at sporting events for example, are typically comprised of a single, homogeneous layer of soft, resilient material such as foam rubber, completely covered on both sides thereof by sheets of vinyl (or some equivalent material). These pads tend to wear out rather quickly due to the resilient core material being loosely held within the covering. The pads also tend to slide and easily shift upon the seat while the user is sitting upon it due to the low coefficient of friction of the outer layers of the chair pad.

Some prior art chair pads attempt to remedy the slipping problem exhibited by other pads. For example, U.S. Pat. No. 5,015,037 issued to Giblin et al on May 14, 1991 discloses a nonslip chair pad made from a single piece of solid, rubbery material which provides a high coefficient of friction. The pad also includes a plurality of apertures formed therethrough to permit the passage of liquids since the pad is intended to be used on a baby's highchair. The main concerns of providing an anti-slip covering for a baby's highchair while also taking into consideration the probability of accidental spills seems to have been adequately addressed by the Giblin et al chair pad. However, the only cushioning appears to come from the resilient property of the rubbery material from which the chair pad is made. Also, it does not appear to have any decorative concerns and would likely be unacceptable in both comfort and style for adult use, especially in an office setting.

U.S. Pat. No. 4,627,660 issued to Kon on Dec. 9, 1986 discloses a method for making a seat pad more decorative by forming "fake" decorative buttons on an automobile seat The disclosed method involves placing a button core member against a first surface of the trim cover (a lamination of a top cover member, a wadding of foam material, and a wadding cover), placing a reinforcing member against the bottom core member, and simultaneously pressing and heating the trim cover and the reinforcing member about the button core member whereby a stylized depression is formed in the trim cover by the button core member. The top cover member, the wadding of foam material and the wadding cover are integrally welded to one another at the depression.

It is a principal object of the present invention to provide a transportable chair pad which is comfortable, durable and attractively designed.

It is another object of the present invention to provide a chair pad having an outer, chair-contacting surface thereof which has a relatively high coefficient of friction.

It is a further object of the present invention to provide a chair pad which is relatively simple in design and construction, inexpensive to manufacture and which is otherwise economically attractive.

Other objects will in part be obvious and in part appear hereinafter.

SUMMARY OF THE INVENTION

In accordance with the foregoing objects, the present invention provides a transportable chair pad having improved durability, comfort and design over chair pads known heretofore. The chair pad of the present invention is comprised of four separate layers, namely, a top layer of sheet vinyl; a bottom layer of sheet vinyl completely covered on the outside by a thin layer of non-clickable, ester urethane foam; and a relatively thick polyurethane core positioned between the two vinyl layers. Thus, one outer surface (which will be regarded as the top surface) is vinyl, and the opposite outer surface (which will be regarded as the bottom surface) is non-clickable, ester urethane foam. The term "non-clickable" foam is a term commonly used in the urethane industry to mean a foam which will tend to remain compressed at the point of die-cutting. Further, the "ester" urethane foam is preferred for the application herein described since it exhibits a higher tensile strength than ether urethane foam of the same density, and also provides a high coefficient of friction.

The polyurethane core (preferably approximately 1.5 inches thick) is provided with an array of holes formed therethrough. The bottom vinyl layer which also possesses a high tensile strength, is fixedly attached to the bottom ester foam layer to further increase the outer foam layer's strength which provides a truly secure bottom backing for the pad. The bottom vinyl layer further includes a plurality of through holes cut therethrough to provide aeration through the ester foam layer to the inner, polyurethane layer. The two vinyl layers provide a durable, pliable chair pad and form a very strong bond when heat sealed together. In particular, the top and bottom layers are heat sealed about their perimeters and through each one of the plurality of holes in the center polyurethane foam layer to form tufts, each of which are formed to include an inner air pocket.

A unique and efficient process is performed to manufacture the chair pads of the present invention. The following steps are performed in sequence to achieve the desired results. The steps in the manufacturing process are:

1. Cut two sheets of vinyl and one sheet of non-clickable foam into 20 inch by 20 inch squares;
2. Cut or otherwise form a plurality of through holes through one of the sheets of vinyl for the bottom of the chair pad;
3. Fixedly attach (e.g. glue) the bottom sheet of the vinyl and non-clickable foam together such that the two sheets are in complete covering relation to one another;
4. Place the other sheet of the vinyl to be used for the top surface of the pad over a mold having a plurality of raised bosses to form a plurality of indentations in the vinyl by application of heat and vacuum thereto.
5. Using fabricated dies, a 21 inch by 21 inch, 1.5 inch thick piece of polyurethane is die cut into this preferred chair pad shape with an array of holes cut through the polyurethane in predetermined number and pattern. The indentations formed in the top vinyl layer and in the polyurethane layer precisely correspond in both number and position;

6. Place the polyurethane between the two layers of vinyl such that the indentations in the top vinyl layer are axially aligned with and extend within the holes in the polyurethane layer. Place the assembly pieces in a sandwich-type, vacuum forming machine which heat seals the top vinyl surface to the bottom vinyl and non-clickable ester foam layer both at the periphery thereof and through each hole in the polyurethane layer.

7. Trim off any excess material which may have formed outside the peripherally formed seam.

The above described process is advantageous to mass production of chair pads as it can easily be arranged in assembly line fashion. With the inexpensive tooling and material costs, and the efficient production of the chair pads, the cost to the consumer is minimized while still providing a durable, reliable product.

BRIEF DESCRIPTION OF THE DRAWING FIGURES

DETAILED DESCRIPTION OF THE PREFERRED EMBODIMENT

Figure 1:
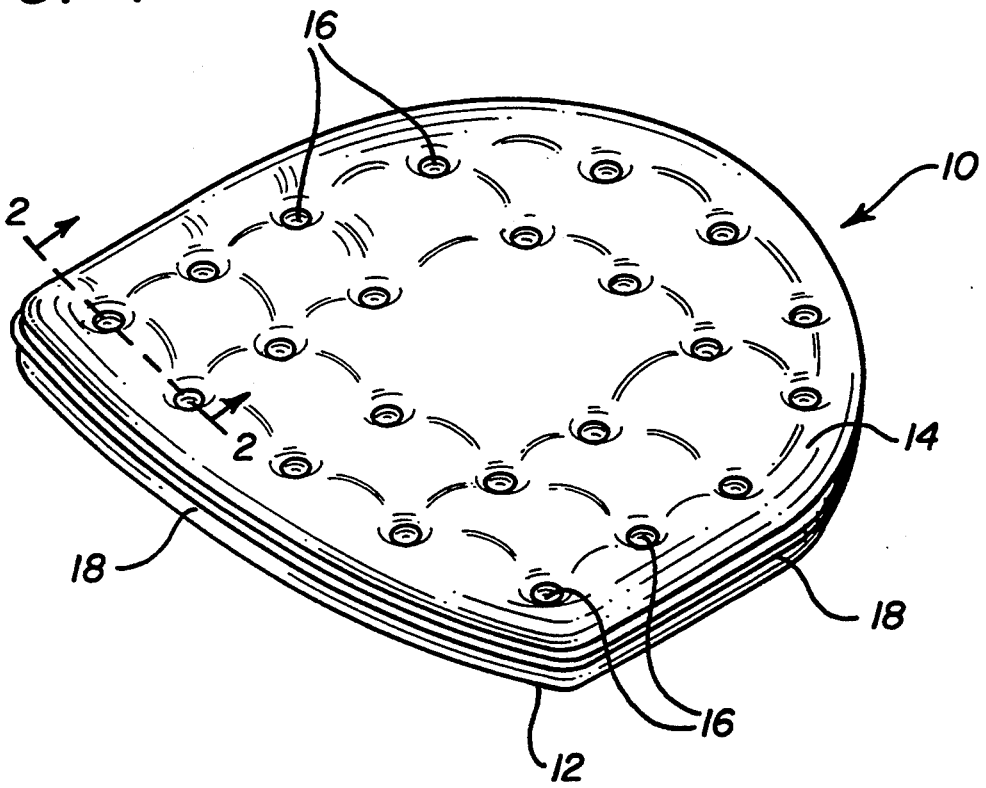
FIG. 1 is a perspective view of the chair pad made in accordance with the present invention.

Referring now to the drawing figures, there is seen in FIG. 1 a chair pad or seat cushion denoted generally by reference numeral 10. Chair pad 10 is seen to have a bottom, chair-contacting surface 12 and a top surface 14 including a plurality of indented, artificial buttons or "tufts" 16. Bottom surface 12 and top surface 14 are joined together about their periphery at seam 18 as well as at each tuft 16. Seam 18, and the bonds occurring at each tuft 16, are formed with a sandwich-type vacuum and heat sealing machine (not shown) which simultaneously applies heat, suction, and pressure.

Figure 3:
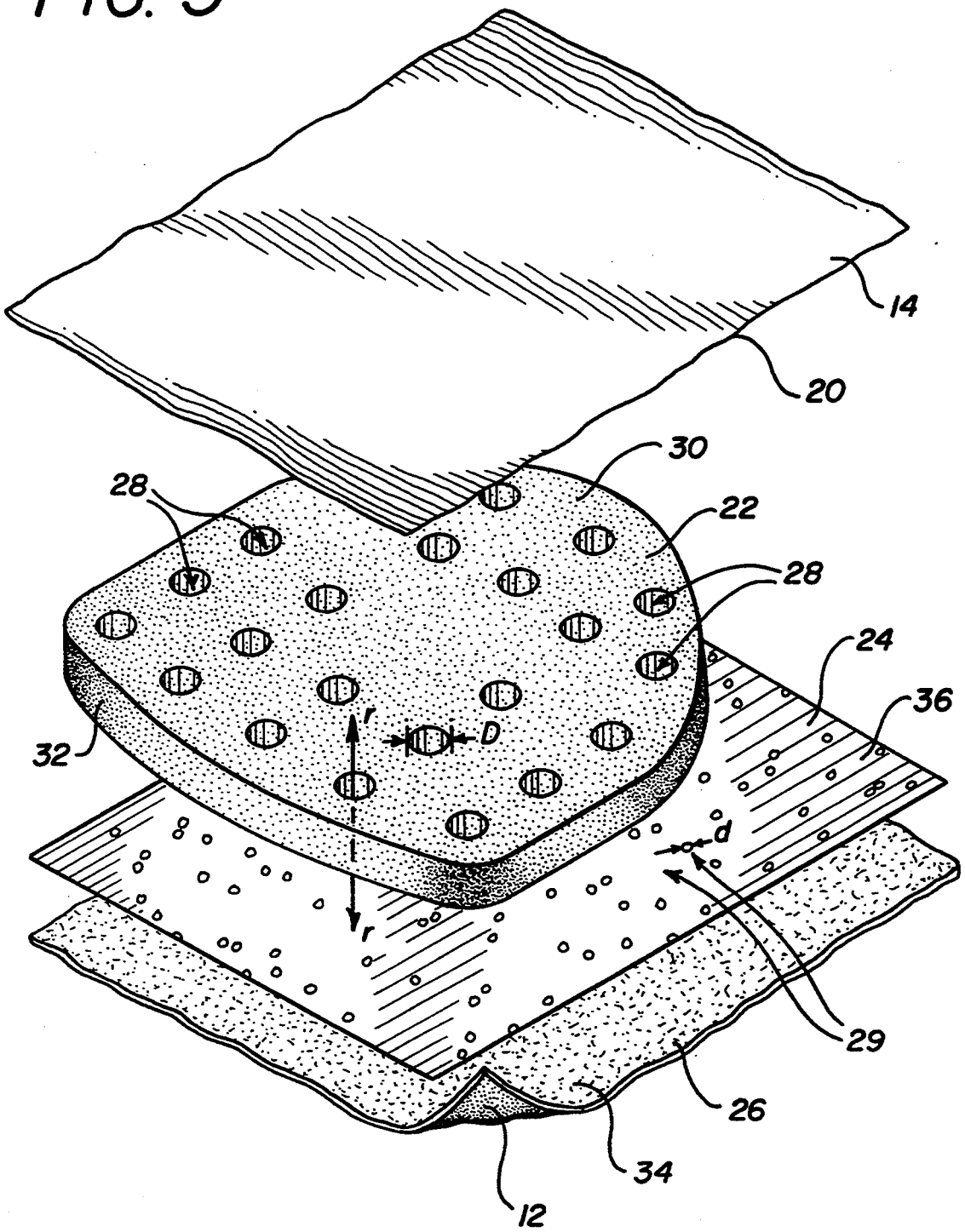
FIG. 3 is an exploded, perspective view showing the four individual layers of material used to make the chair pad of FIGS. 1 and 2.

As best seen in the exploded view of FIG. 3, chair pad 10 is comprised of four independent and distinct layers, namely, top vinyl layer 20 which comprises said top surface 14; polyurethane core layer 22, reinforcing vinyl layer 24; and bottom, non-clickable, ester urethane foam layer 26 which comprises said bottom surface 12.

Figure 2:
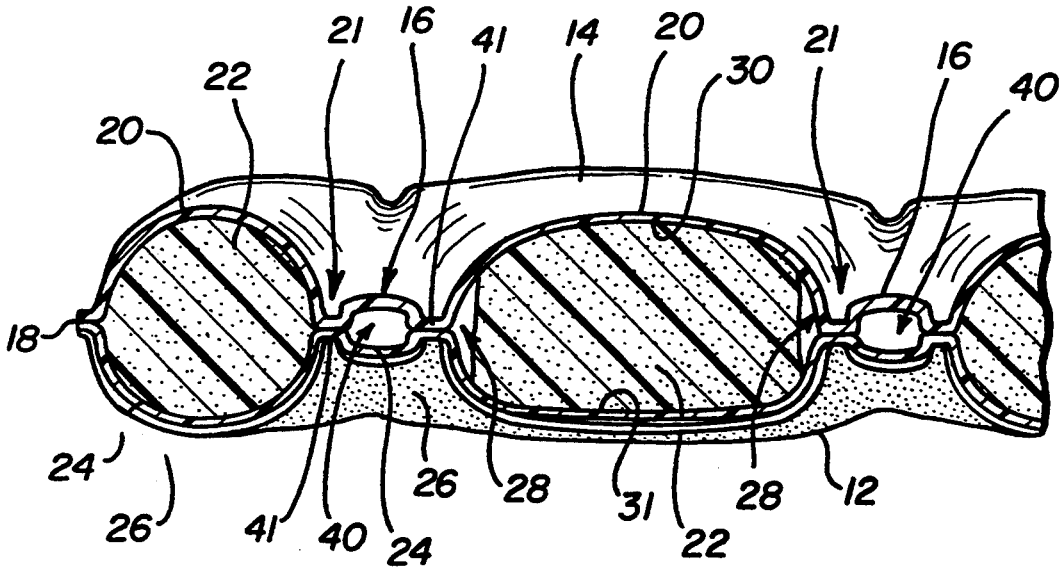
FIG. 2 is an elevational, cross sectional view taken generally along the line 2—2 of FIG. 1.

Polyurethane core layer 22 is approximately 1.5 inches thick and is cut or otherwise formed with a plurality of holes 28 having a diameter D extending therethrough in a predetermined pattern spread. Polyurethane core layer 22 includes a top surface 30 and opposite bottom surface 31 (FIG. 2) which lie in spaced, substantially parallel planes including a contiguous sidewall 32 extending perpendicularly therebetween. Further, holes 28 each include a radial axis r—r which extends perpendicular to the planes in which the top and bottom surfaces of resilient material 22 lie. The density and resilient nature of polyurethane layer 22 provides chair pad 10 with a comfortable, long lasting core.

Non-clickable, ester urethane foam layer 26 is approximately 0.06 inches thick and inherently possesses a high coefficient of friction which keeps chair pad 10 from slipping upon a chair seat when in use. Vinyl layer 24, which has a high tensile strength, is fixedly attached in complete covering relation to the bottom foam layer 26, thereby providing a strong bottom surface for chair pad 10. Vinyl layer 24 includes a top surface 36 which, as described more fully below, lies in contacting, covering relation to polyurethane core layer 22 in the fully assembled condition of chair pad 10 seen in FIGS. 1 and 2. Vinyl layer 24 further includes a plurality of through holes 29 cut therethrough with the bottom surface thereof affixed to bottom foam layer 26 which together provide a truly secure bottom backing for chair pad 10. Holes 29 have a diameter d smaller than diameter D of holes 28 in polyurethane core 22 and act to provide aeration thereto through bottom foam layer 26.

Figure 4:
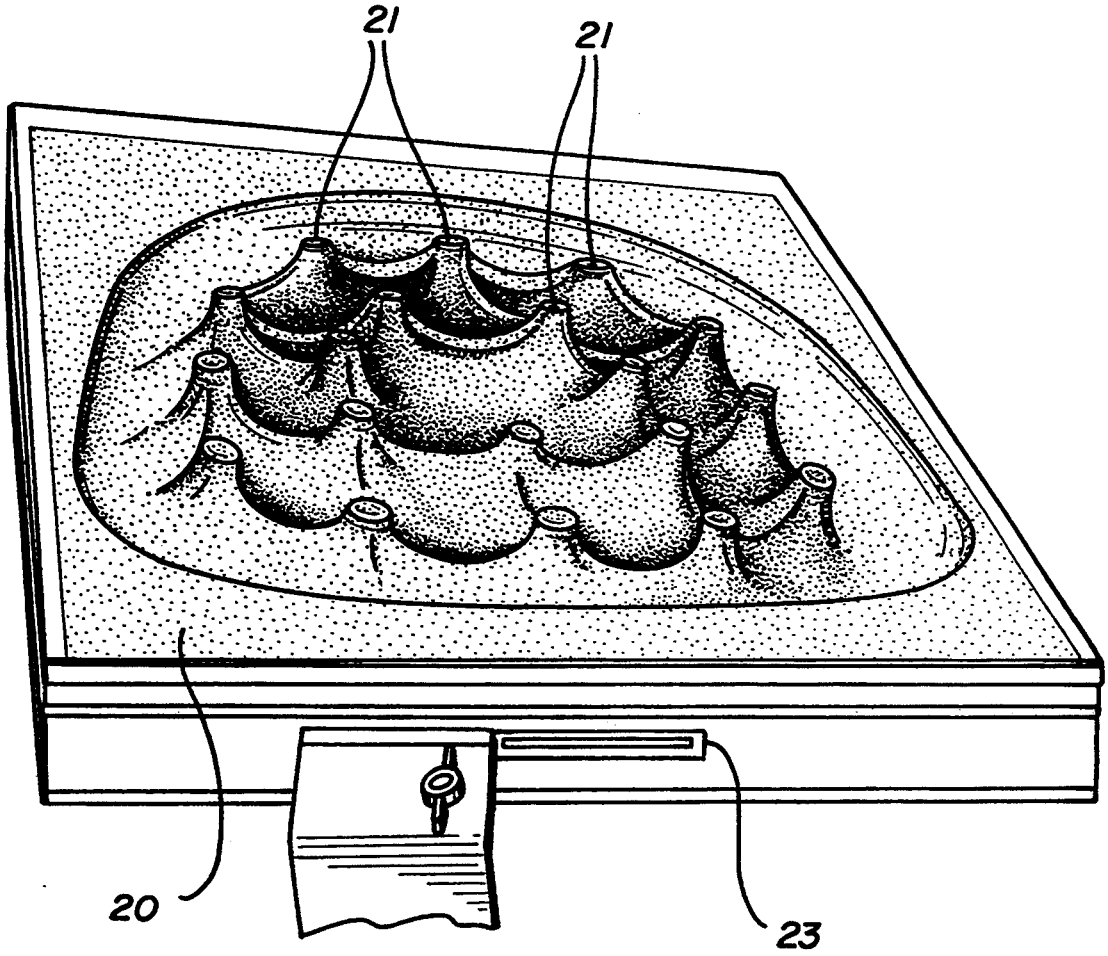
FIG. 4 is a perspective view showing the top vinyl layer of the chair pad seen in FIG. 3 placed in a mold having a plurality of raised bosses therein.

Although not shown in FIG. 3, top vinyl layer 20 is molded prior to assembly to form a plurality of raised indentations 21 therein as may be seen in FIG. 4. In particular, top layer 20 is placed into a custom fabricated mold 23 and heat and suction are applied thereto to form raised indentations 21 which correspond precisely in number and position to holes 28 formed in polyurethane core layer 22. During assembly of the various layers to form chair pad 10, the raised indentations 21 in top layer 20 are aligned with and extend into holes 28 in polyurethane core layer 22.

Referring to FIG. 3 which shows a cross-section through two tufts 16 of a fully assembled chair pad 10, it will be seen that tufts 16 are formed through each hole 28 in polyurethane core layer 22. Specifically, to form chair pad 10, all four layers 20, 22, 24 and 26 are placed into a sandwich-type vacuum pressing machine (not shown) with polyurethane core layer 22 laid in covering relation upon the top surface 36 of bottom vinyl layer 24 which is opposite bottom foam layer 26. Next, top vinyl layer 20 is laid in covering relation to core layer 24 opposite bottom layers 24 and 26, with indentations 21 aligning with and extending into holes 28 in core layer 24. Upon activation of the vacuum pressing machine, tufts 16 are formed with top vinyl layer 20 being fixedly secured to bottom layers 24 and 26 through each hole 28 and also about the periphery thereof forming peripheral seam 18.

Each tuft 16 is formed with the heat seal extending in a circle 41 which has a diameter smaller than the diameter of holes 28, the circular configuration of the heat seal creating a central air pocket 40 therein and between top and bottom vinyl layers 20 and 24. Since only the vinyl layers 20 and 24, and not the bottom foam layer 26, can be adhered together using the heat sealing technique, the holes 29 in bottom vinyl layer 24 do not align with holes 28 in polyurethane core 22.

Tufts 16 are seen to be positioned between the top and bottom surfaces of resilient material 22 and provide not only a stylized depression, but also tufts which are cushioned with air. Furthermore, and very importantly, by virtue of tufts 16 being formed through each hole 28 in polyurethane core layer 22 besides at seam 18, layer 22 is fixedly secured with respect to outer covering layers 20, 24 and 26. This alleviates the force upon seam 18 when in use since the polyurethane foam layer 22 cannot move relative to outer covering layers 20, 24 and 26.

The invention has been described with particular reference to a preferred embodiment thereof. It will be obvious to those skilled in the art that various changes and modifications, such as particular dimensions and materials used, may be made to the invention without departing from the full spirit and scope of the invention which is defined by the claims which follow.

What is claimed is:

1. A transportable chair pad consisting essentially of:

a) a layer of resilient material having a predetermined thickness outline and cross dimensions, said resilient material further having top and bottom surfaces and a first plurality of through holes of a first predetermined diameter extending from said top surface to said bottom surface in a predetermined array pattern, and wherein said resilient material is polyurethane;

b) top and bottom layers of flexible, heat-sealable material having perimeters and cross-dimensions larger than said resilient material cross dimension and positioned in covering relation to said top and bottom surfaces thereof, respectively, said perimeters of said top and bottom layers being fixedly heat-sealed together adjacent said perimeter of said resilient material to form a peripheral seam, and portions of said top and bottom layers being fixedly heat-sealed together through each of said holes in said resilient material with each of said seals being of circular configuration having a diameter smaller than said diameters of said holes with said sealed portions having an inner air pocket between said top and bottom layers in said circle to form tufts positioned in said holes between said top and bottom surfaces of said resilient material, said top layer of flexible material being preformed with a plurality of indentations, the number and positions thereof being the same as said first plurality of through holes and said predetermined array pattern, respectively, in said layer of resilient material, said indentations in said top layer aligned with and extending within said through holes, respectively, when said top layer is placed in said covering relation to said top surface of said resilient material, said bottom layer including a second plurality of through holes formed therethrough, said second plurality of through holes having a second predetermined diameter smaller than said first predetermined diameter, and wherein said second plurality of holes are not in alignment with said first plurality of holes, and wherein said heat sealable material is vinyl; and c) a layer of non-clickable, ester urethane foam positioned in complete covering relation to the surface of said bottom layer opposite the surface contacting said resilient material, said layer of ester urethane foam including a perimeter which is fixedly sealed to said sealed perimeters of said top and bottom layers, and wherein said layer of ester urethane foam includes portions thereof fixedly sealed to said portions of said top and bottom layers in said holes in said resilient material.

2. The invention according to claim 1 wherein said predetermined thickness of said resilient material is about 1.5 inches.

* * * * *